US010835051B2

(12) United States Patent
Patmore et al.

(10) Patent No.: US 10,835,051 B2
(45) Date of Patent: Nov. 17, 2020

(54) PERSON SUPPORT

(71) Applicant: Stryker Corporation, Kalamazoo, MI (US)

(72) Inventors: Kevin Mark Patmore, Plainwell, MI (US); Tyler Scott Wright, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 328 days.

(21) Appl. No.: 15/834,155

(22) Filed: Dec. 7, 2017

(65) Prior Publication Data

US 2018/0168361 A1 Jun. 21, 2018

Related U.S. Application Data

(60) Provisional application No. 62/434,723, filed on Dec. 15, 2016.

(51) Int. Cl.
*A47C 27/14* (2006.01)
*A47C 27/15* (2006.01)
(Continued)

(52) U.S. Cl.
CPC ..... *A47C 27/144* (2013.01); *A47C 27/081* (2013.01); *A47C 27/083* (2013.01);
(Continued)

(58) Field of Classification Search
CPC ... A47C 31/006; A47C 27/081; A47C 27/083; A47C 27/085; A47C 27/14;
(Continued)

(56) References Cited

U.S. PATENT DOCUMENTS 2,229,536 A * 1/1941 Wilkich ..... A47C 27/125 5/731
3,828,378 A * 8/1974 Flam ..... A61G 7/05707 5/730

(Continued)

FOREIGN PATENT DOCUMENTS

| | | |
|---|---|---|
| CA | 2166106 C | 9/2000 |
| GB | 2347346 B | 4/2003 |
| WO | 9500052 A1 | 1/1995 |

OTHER PUBLICATIONS

ComfortGel Support Surface, Stryker Operations Manual, Jul. 2016.

(Continued)

*Primary Examiner* — David R Hare
(74) *Attorney, Agent, or Firm* — Warner Norcross + Judd LLP

(57) ABSTRACT

A person support for supporting a person includes a first layer and a resilient second layer. The first layer has a surface topography with a first region with a curvature configured to correspond and generally conform, in an unloaded state, to the shape of a first portion of a person's body. The surface topography has a second region configured to correspond and generally conform, in an unloaded state, to the shape of a second portion of a person's body. The resilient second layer overlays the first layer and forms a person support surface.

14 Claims, 6 Drawing Sheets

(51) Int. Cl.

| | |
|---|---|
| ***A61G 7/057*** | (2006.01) |
| ***A47C 27/08*** | (2006.01) |
| ***A47C 27/22*** | (2006.01) |
| ***A47C 31/00*** | (2006.01) |
| ***A47C 27/12*** | (2006.01) |
| ***A47C 27/18*** | (2006.01) |

(52) U.S. Cl.
CPC ..... *A47C 27/085* (2013.01); *A47C 27/121* (2013.01); *A47C 27/125* (2013.01); *A47C 27/148* (2013.01); *A47C 27/15* (2013.01); *A47C 27/18* (2013.01); *A47C 27/22* (2013.01); *A47C 31/006* (2013.01); *A61G 7/05723* (2013.01); *A61G 7/05738* (2013.01); *A61G 7/05792* (2016.11)

(58) Field of Classification Search
CPC ... A47C 27/142; A47C 27/144; A47C 27/148; A47C 27/125; A47C 27/121; A47C 27/15; A47C 27/18; A47C 27/22; A61G 7/05707; A61G 7/05723; A61G 7/05738; A61G 7/05792
See application file for complete search history.

(56) References Cited

U.S. PATENT DOCUMENTS

| | | | | | |
|---|---|---|---|---|---|
| 3,846,857 | A * | 11/1974 | Weinstock | A47C 27/148 | 5/727 |
| 3,885,257 | A * | 5/1975 | Rogers | A47C 27/144 | 5/730 |
| 3,885,258 | A * | 5/1975 | Regan | A47C 27/144 | 5/727 |
| 4,053,957 | A * | 10/1977 | Regan | A47C 23/00 | 5/727 |
| 4,665,573 | A * | 5/1987 | Fiore | A47C 27/148 | 5/731 |
| 4,688,283 | A * | 8/1987 | Jacobson | A47C 27/081 | 5/709 |
| 4,706,313 | A * | 11/1987 | Murphy | A47C 27/148 | 5/722 |
| 5,179,742 | A | 1/1993 | Oberle | | |
| 5,224,226 | A * | 7/1993 | Groenewald | A47C 27/146 | 5/632 |
| 5,231,717 | A * | 8/1993 | Scott | A47C 27/148 | 5/400 |
| 5,815,862 | A * | 10/1998 | Rygiel | A47C 27/081 | 5/632 |
| 6,334,442 | B1 | 1/2002 | Altamura | | |
| 6,357,066 | B1 * | 3/2002 | Pierce | A61B 6/0442 | 5/710 |
| D479,082 | S * | 9/2003 | Daughtery | A47C 27/15 | D6/596 |
| 6,807,698 | B2 * | 10/2004 | Torbet | A47C 27/082 | 5/710 |
| 7,065,816 | B2 * | 6/2006 | McGettigan | A47C 20/025 | 5/727 |
| 7,100,229 | B2 * | 9/2006 | O'Reagan | A47C 27/146 | 5/731 |
| 7,574,762 | B2 * | 8/2009 | Baker | A47C 27/001 | 5/721 |
| 7,685,664 | B2 | 3/2010 | Stolpmann et al. | | |
| D779,236 | S | 2/2017 | Ribble et al. | | |
| 9,854,922 | B1 * | 1/2018 | Schiller | A47C 27/15 | |
| 10,357,115 | B2 * | 7/2019 | Oh | A47C 27/146 | |
| 2005/0115003 | A1 * | 6/2005 | Torbet | A47C 27/082 | 5/727 |
| 2006/0260060 | A1 * | 11/2006 | Apperson | A47C 27/05 | 5/691 |
| 2007/0044245 | A1 * | 3/2007 | Bryant | A47C 27/146 | 5/727 |
| 2010/0212087 | A1 | 8/2010 | Leib et al. | | |
| 2010/0264571 | A1 * | 10/2010 | Tarazona De La Asuncion | A47C 27/144 | 267/141 |
| 2011/0283461 | A1 * | 11/2011 | Rasmussen | A47C 27/146 | 5/731 |
| 2013/0067662 | A1 | 3/2013 | Jusiak et al. | | |
| 2013/0081208 | A1 * | 4/2013 | Dyevich | A47C 27/142 | 5/727 |
| 2014/0068869 | A1 | 3/2014 | Lafleche et al. | | |
| 2014/0109320 | A1 * | 4/2014 | Chunglo | A47C 27/146 | 5/740 |
| 2014/0289964 | A1 | 10/2014 | Dodd | | |
| 2015/0128352 | A1 | 5/2015 | Papaioannou | | |
| 2015/0265063 | A1 * | 9/2015 | Cappadona | A47C 27/002 | 5/698 |
| 2015/0305514 | A1 * | 10/2015 | Kulju | A47C 27/05 | 5/727 |
| 2017/0156508 | A1 * | 6/2017 | Segal | A47C 27/001 | |
| 2019/0328149 | A1 * | 10/2019 | Campbell | A47C 27/142 | |

OTHER PUBLICATIONS

Centrella Smart+ Bed Therapeutic Surfaces, Hill-Rom Manual, Sep. 20, 2017.
IsoFlex LAL Support Surface, Stryker Operations/Maintenance Manual, Aug. 2017.
Isolibrium Support Surface, Stryker Operations/Maintenance Manual, Oct. 2014.

* cited by examiner

PERSON SUPPORT

CROSS-REFERENCE TO RELATED APPLICATIONS

This application claims priority to U.S. provisional patent application Ser. No. 62/434,723 filed Dec. 15, 2016, by inventors Kevin Mark Patmore et al. and entitled A PERSON SUPPORT, the complete disclosure of which is incorporated herein by reference.

TECHNICAL FIELD AND BACKGROUND OF THE INVENTION

The present disclosure relates to supports for people, and also objects.

With regard to people, the body of a human is not flat. Therefore, when a person is subjected to a flat cushion or mattress surface, the cushion or mattress responds as a nonlinear spring, with areas of the body that immerse deeper into the cushion or mattress encountering a higher return force from the cushion or mattress to suspend the patient in an equilibrium state. Therefore, when a person is lying down or sitting for extended periods of time, the reactive forces on the body from the surface on which they are lying or sitting can cause regions of greater stress, which can cause discomfort and, in some cases, lead to the development of pressure sores.

Similar issues arise when supporting objects—for example, when storing or transporting an object, forces that are transmitted to the object may not be uniformly distributed across the interface with the object. If the object is fragile, these forces can, therefore, possibly deform or damage the object.

Accordingly, there is a need for supports that can better distribute pressure to a person or an object that is being supported.

SUMMARY OF THE INVENTION

A person support is described that aims to improve a person's comfort and pressure redistribution by contouring features of the support.

In one embodiment, a person support includes an upper layer and a lower layer, which supports the upper layer and forms therewith a non-linear interface.

In another embodiment, a person support includes a first layer and a second layer. The first layer has an upper side with a surface topography with a first region having a curvature configured to correspond and generally conform, in an unloaded state, to the shape of a first portion of a person's body. The upper side may also include a second region configured to correspond and generally conform, in an unloaded state, to the shape of a second portion of the person's body. A resilient second layer may be provided that overlays the first layer, with the resilient second layer forming a person support surface.

In one aspect, the resilient second layer conforms to the surface topography of the first layer.

In any of the person supports above, when unloaded the resilient second layer includes a generally planar upper surface that forms the person support surface, which planar upper surface may be horizontal or may have portions that are angled to form a tapered support surface. For example, a tapered support surface may be suitable at the foot end of the person support.

In any of the above person supports, the first region of the surface topography may be configured to at least generally conform to the buttocks and hip region of a person.

In any of the above person supports, the upper side of the first layer may also include a third region, which corresponds and generally conforms to the shape of a third portion of the person's body. For example, in one embodiment, the second region is configured to at least generally conform to the upper back of a person.

In any of the above, the resilient second layer may comprise a foam layer, a gel layer, a 3D fabric layer, or a bladder layer, or a combination of two or more thereof.

Further, in any of the above, the first layer may comprise a resilient first layer. For example, the resilient first layer may comprise a foam layer, a gel layer, a 3D fabric layer, or a bladder layer, or a combination of two or more thereof.

In any of the above, the person support may further comprise a third layer, with the third layer positioned either between the first layer and the resilient second layer or beneath the first layer or above the resilient second layer.

In one embodiment, the layers form a mattress or a cushion for a bed, a stretcher, an EMS cot, a recliner chair, or an operating room (OR) table.

In another embodiment, a person support includes a first layer having an upper side, a lower side, and a longitudinal axis, and a resilient second layer. The resilient second layer has a lower side and an upper side, with the lower side of the resilient second layer supported on the upper side of the first layer. Further, the upper side of the resilient second layer forms a person facing side. The upper side of the first layer has a surface topography that has at least one curvature that forms a shape, in an unloaded state, to generally follow the shape of a person's body along at least along the longitudinal axis or lateral axis of the first layer to thereby form a 2D profile, or optionally along the longitudinal axis and the lateral axis of the first layer to form a 3D profile. Further, the resilient second layer comprises a compressible layer to accommodate variations in the shapes and sizes of persons lying or sitting on the person support.

In one aspect, the upper side of the resilient second layer is generally planar or has planar regions when unloaded. Optionally, one or more planar regions of the upper side may be angled to form a tapered surface.

Further, the lower side of the resilient second layer may have a surface topography that substantially matches the surface topography of the upper side of the first layer.

In any of the above, the first layer optionally comprises a resilient first layer. Alternately, the first layer may be a rigid first layer.

In any of the above, one or more of the layers may form a component of a low air loss system.

In addition, in any of the above, the person support may further comprise a third layer (or other additional layers) between the first layer and the resilient second layer or beneath the first layer or above the resilient second layer.

In another aspect, in any of the above, any one or more of the three layers may form a component of a low air loss system. For example, one of the three layers may include transverse passageways that allow air to flow through the layer.

In any of the above, the plurality of curvatures of the surface topography of the upper side of the first layer forms a shape to generally follow the shape of the full length of a person's body. Alternately, the upper side of the first layer may have one contoured portion with a curvature, with the remaining portion or portions being generally planar.

Further, the surface topography of the upper side of the first layer may have a plurality of curvatures that form a shape, in an unloaded state, to generally follow the shape of a person's body laterally and longitudinally.

According to yet another embodiment, a person support includes a layer having an upper side, which upper side has a surface topography. In an unloaded state, the surface topography has a plurality of curvatures with a shape to generally follow the shape of at least a portion of a person's body in a supine position.

In one aspect, the contours have a shape to generally follow the shape of at least a portion of a generalized profile of a person's body in a supine position.

In another aspect, the layer comprises a first layer. And the person support further comprises a resilient insert or resilient layer to actively or passively modify one or more of the curvatures of the surface topography of the first layer.

In yet another aspect, the first layer may comprise a resilient first layer.

In a further aspect, the resilient insert or resilient layer comprises a resilient second layer having a lower side and an upper side. The lower side of the resilient second layer is supported on the resilient first layer, with the upper side of the resilient second layer forming a person support surface.

In another aspect, in any of the above, the lower side of resilient second layer is configured to conform to the surface topography of the upper side of the resilient first layer.

For example, the resilient insert or resilient layer may comprise a foam insert or layer, a gel insert or layer, a 3D fabric insert or layer, or a bladder insert or layer, or a combination of two or more thereof.

Similarly, the first layer may comprise a foam layer, a gel layer, a 3D fabric layer, or a bladder layer, or a combination of two or more thereof.

In any of the above, first layer and the optional second layer may form a mattress or a cushion for a bed, a stretcher, an EMS cot, a recliner chair, an OR table, or the like.

In yet another embodiment, a person support includes a resilient layer having an upper side with a surface topography. In an uncompressed state, the surface topography has a shape to generally follow the shape of at least a portion of a person's body in a supine position or seated position wherein when a person lies or sits on the resilient layer the amount of deformation of the resilient layer under the person will be substantially equal so that the resulting distribution of pressure on the person's body will be substantially equal.

In one aspect, the surface topography (in an uncompressed state) has a shape to follow the shape of a generalized profile of a person's body in a supine position or seated position.

In further aspects, in any of the above, the resilient layer comprises a resilient first layer, and the person support further includes a resilient insert or resilient layer to actively or passively modify the surface topography of the resilient first layer.

In any of the above, the person support may form a cushion or mattress for a bed, a stretcher, a recliner chair, an emergency medical cot, an OR table, or the like.

In some of the person supports, the second resilient layer (the resilient layer forming the patient support surface) may have a uniform thickness or a variable thickness.

According to yet another embodiment, a method of forming a person support for supporting a person includes providing a resilient layer with an upper surface and configuring the upper surface of the resilient layer so that in an uncompressed state the upper surface generally follows the shape of at least a portion of a person's body in a supine position or seated position. In this manner, when a person lies or sits on the resilient layer the amount of deformation of the resilient layer under the person may be substantially equal so that the resulting distribution of pressure on the person's body may be substantially equal.

DETAILED DESCRIPTION OF THE DRAWINGS

DETAILED DESCRIPTION

Figure 1:
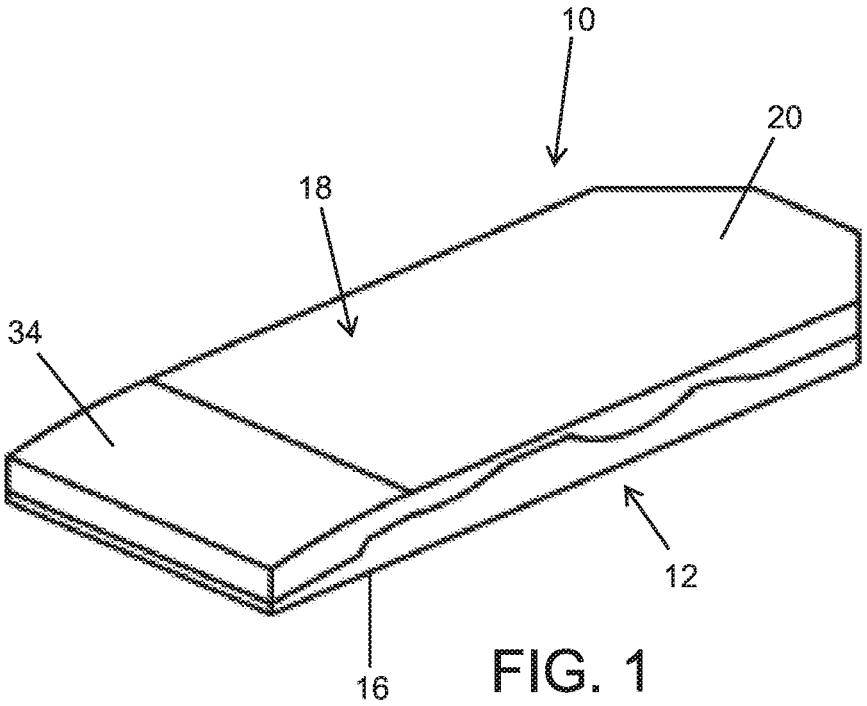
FIG. 1 is a perspective view of a person support.

Referring to FIG. 1, the numeral 10 generally designates a support. In the illustrated support 10 comprises a person support for supporting persons with different body shapes and sizes. As will be more fully described below, person support 10 can support a wide range of body shapes and sizes. It is also contemplated that different versions of person supports may be constructed, for example, with one version more suited to one range of body shapes and sizes, and the other version or versions suited to other body shapes and sizes. Alternately, different versions of the person support may be constructed for different applications, such as for a bed, including a Med Surg bed or an ICU bed, a stretcher, an EMS cot, a recliner chair, an operating room (OR) table or the like.

Figure 2:
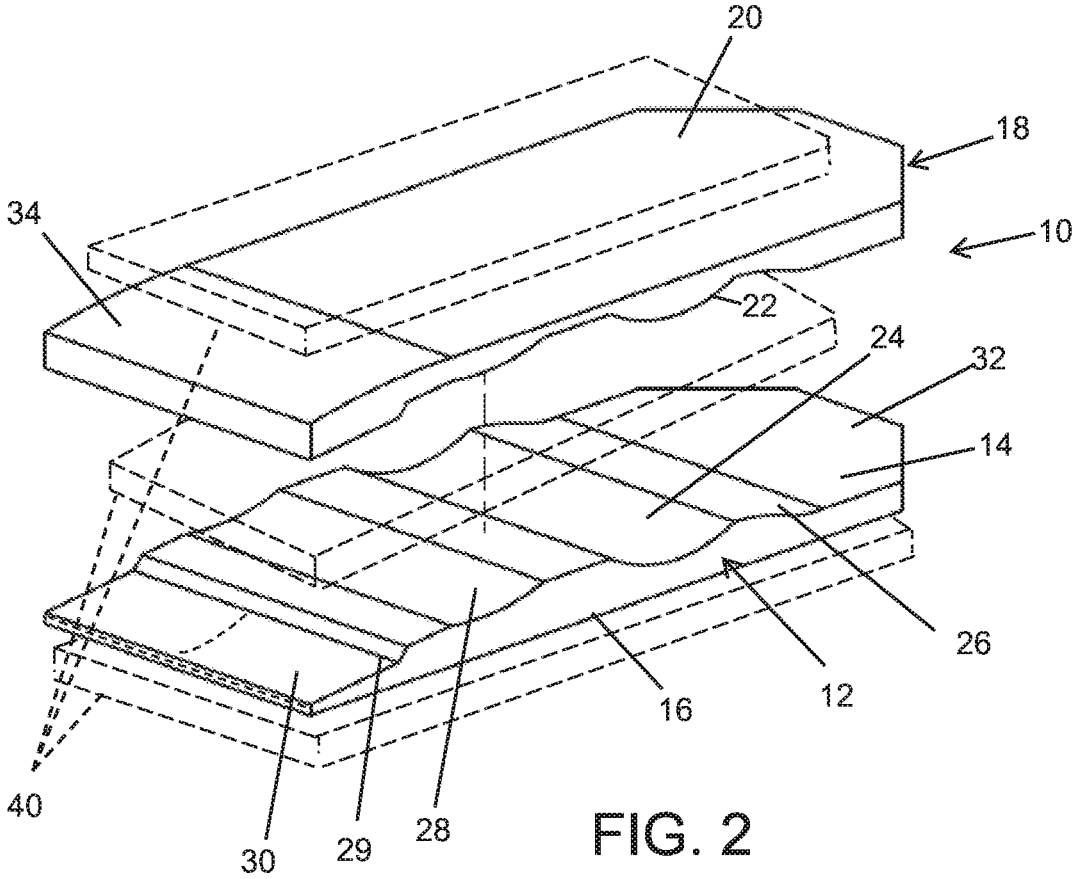
FIG. 2 is an exploded perspective view of the person support of FIG. 1.
Figure 4:
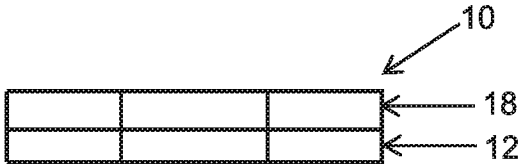
FIG. 4 is an end elevation view of the person support of FIG. 3.
Figure 3:
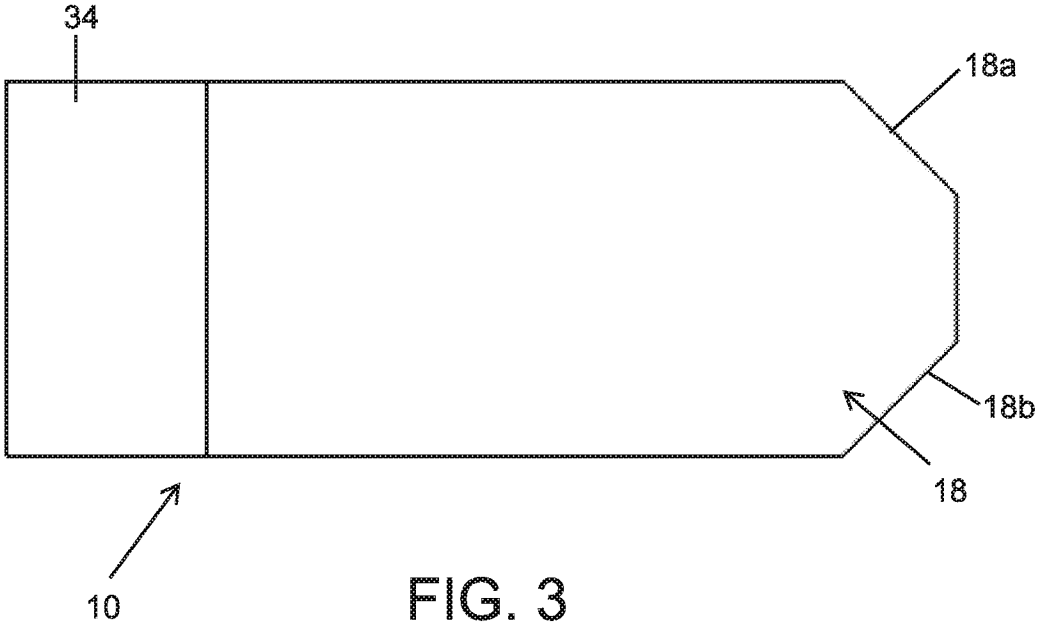
FIG. 3 is a top plan view of the person support of FIG. 1.
Figure 5:
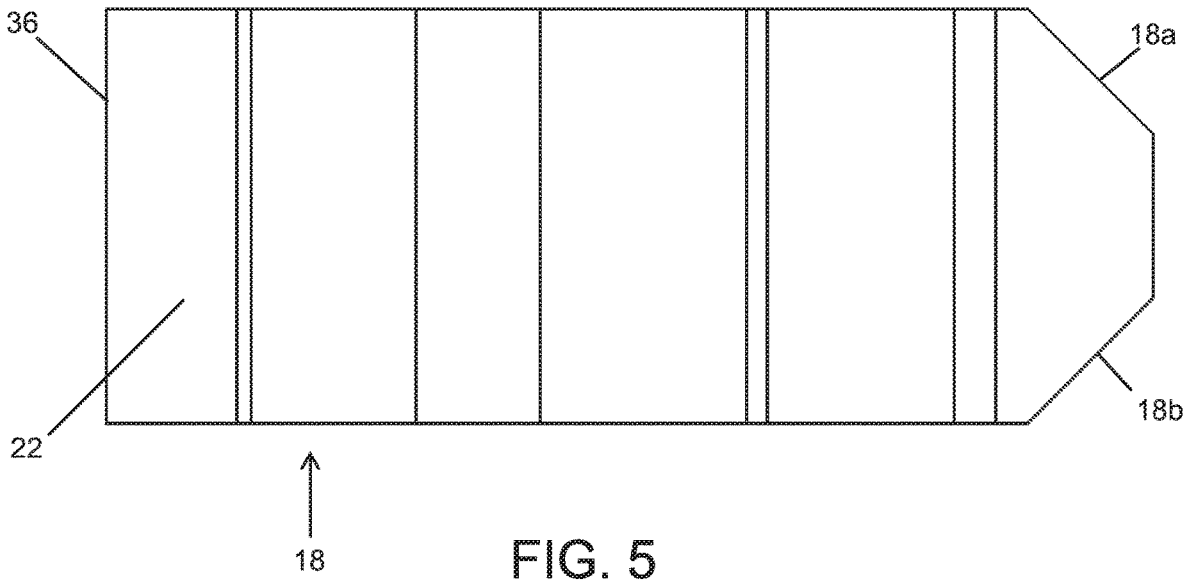
FIG. 5 is a bottom plan view of the upper layer of the person support of FIG. 3.
Figure 7:
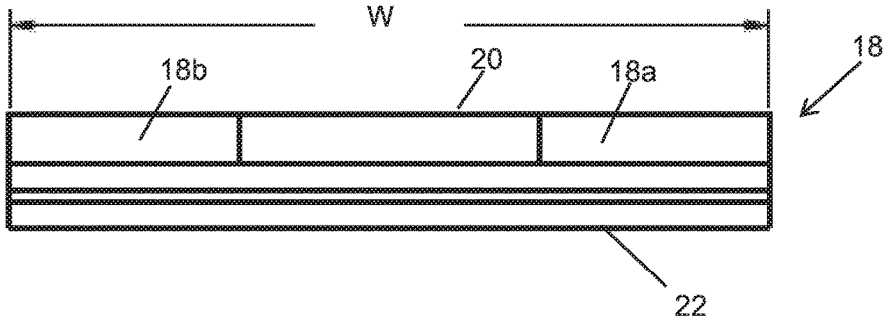
FIG. 7 is an end elevation view of the upper layer of FIG. 6.
Figure 6:
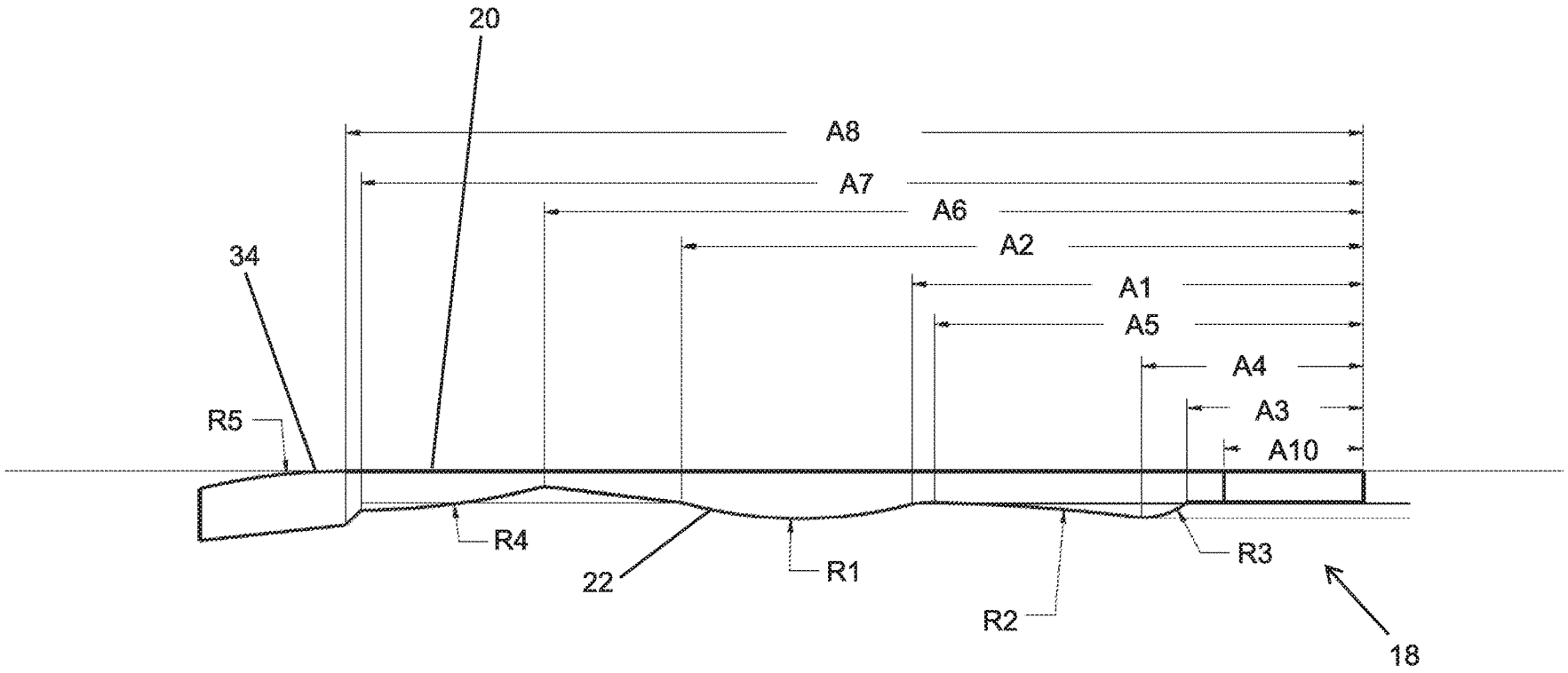
FIG. 6 is a side elevation view of the upper layer of FIG. 5.

Referring to FIG. 2, person support 10 includes at least one layer 12 that is contoured to at least generally follow at least a portion of a person's body profile, for example, a person's body profile when in a supine or seated position. For example, a suitable person's body profile may be based on an average person's body profile or may be based on a generalized shape formed from profiles of a group of different people. Optionally, the profiles may be grouped. For example, a first profile may be generated from persons of average height (e.g. persons who are about 68 inches (172.7 cm)+/−2 inches (+/−5.1 cm) tall), a second profile may be generated from a group of tall people (e.g. people who are 72 inches (182.9 cm)+/−2 inches (+/−5.1 cm) tall), and another profile may be generated for shorter people (e.g. a people who are about 64 inches (162.6 cm)+/−2 inches (+/−5.1 cm) tall). Or profiles may be based on gender, weight, ethnicity, or age or other bases or on their application. Or profiles may be based on an average group of people without differentiating between age, height, weight, ethnicity, or other bases.

In the illustrated embodiment, layer 12 is configured to have an upper side 14 that is contoured with one or more curvatures so that it follows a generalized profile of a person's body (which in the illustrated embodiment was based upon a combination of laser scans from 4 individuals, the Resna SS-1 50$^{th}$ percentile test mannequin, and male and female anthropometric data for key body landmarks from HumanScale [Dreyfus & Associates] and the 1988 Anthropometric Survey of U.S. Army Personnel [Gordon et al 1989]) in a supine position. Further, the contour of the upper side has a two dimensional profile—that is the contour follows the generalized profile along one axis, namely the longitudinal axis of layer 12, so that the contour is uniform across the width but varies along the longitudinal axis of the layer as best seen in FIG. 2. This allows for a person to turn and still have similar pressure redistribution. Optionally, as described below, the profile may be a three dimensional (3D) profile so that the contour follows an average or generalized profile along two axes—the longitudinal and the lateral axes of the layer.

Layer 12 may be made from a rigid material, such as a plastic, including a reinforced plastic, wood, metal, or the like, or may be formed from a resilient material, such as foam, 3D fabric, fluid filled bladders, gel, or the like or a combination of two or more thereof. When formed from a resilient material, the amount of deformation of the resilient material can be approximately equal at all points along the interface with the person so that the reaction forces on the person's body are substantially uniform and, further, the resulting pressure on the person's body will be substantially uniform. By adjusting the shape of layer 12 so that it generally mimics the profile of a person, the pressure is uniformly distributed along the interface with the person's body. Alternately, the profile may be tailored to distribute the reaction forces in a non-uniform manner. For example, where reduction of the reaction force is desired in a particular area, for example, in areas of higher likelihood of pressure injury—namely the sacral region or heels, the profile could have an alternate shape that would lessen the deformation of the resilient material reducing local reaction forces in that desired area or areas.

Figure 8:
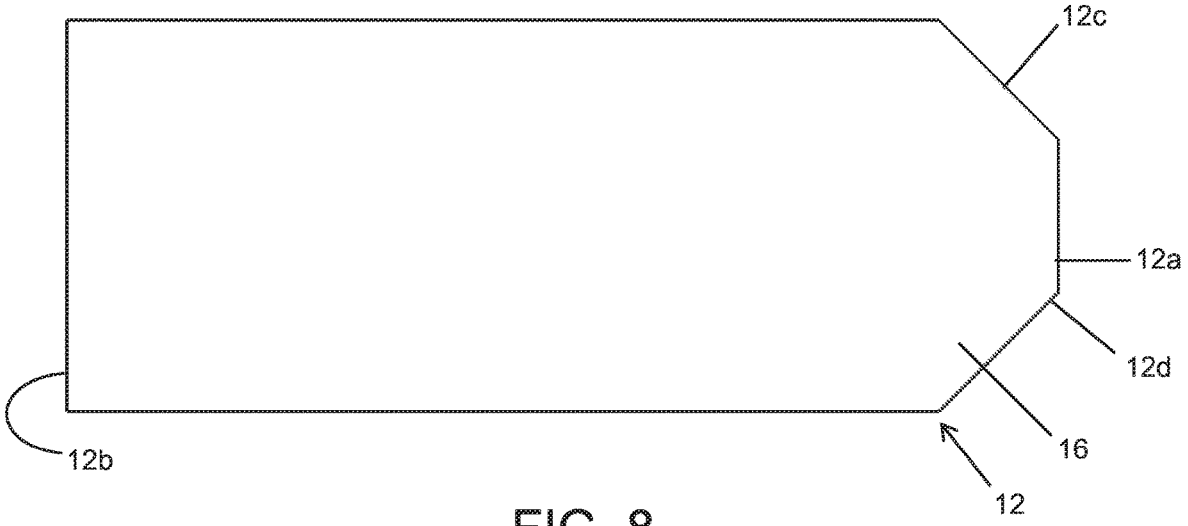
FIG. 8 is a bottom plan view of the lower layer of the support of FIG. 1.
Figure 10:
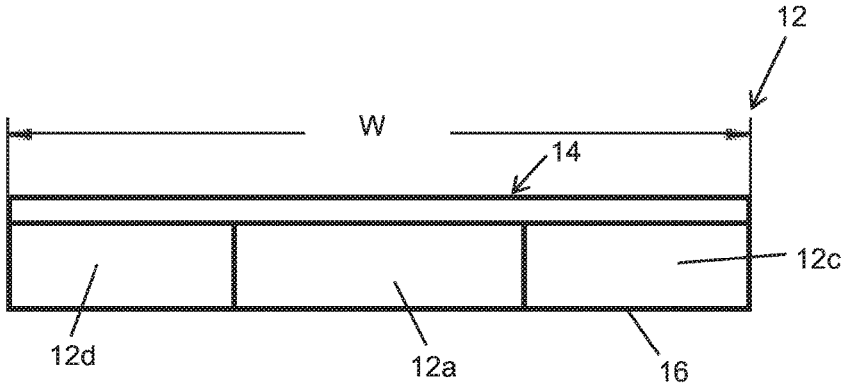
FIG. 10 is an end elevation view of the lower layer of FIG. 9.

Referring to FIG. 8, the bottom side 16 of layer 12 is optionally flat or planar so that it matches the profile of an underlying deck of a bed (e.g. in the case of a medical bed) or foundation of a bed (in the case of a regular bed).

Optionally, support 10 may also include a resilient second layer 18 (FIGS. 2 and 5-7). Second layer 18 is formed from a resilient material, such as foam, gel, 3D fabric, fluid filled bladders, or the like or a combination of two or more thereof. Therefore, similar to layer 12, layer 18 may be formed from a monolithic layer of material or an assembly of components. For example, layer 18 may include inserts, such as gel inserts or fluid bladders, which actively or passively modify the contour of the support. For example, the bladders may be inflated or deflated by a control system to increase or decrease the thickness of that portion of the layer, and further to adjust the stiffness of that portion of the layer. For examples of suitable control systems with pneumatic systems, reference is made to U.S. Pat. Nos. 5,325,551; 8,201,292; 8,911,387; 8,533,879; 7,308,725; 6,079,070, and U.S. Pat. Pub. Appl. 2015/0059100, which are commonly owned by Stryker Corporation and are incorporated by reference herein in their entireties.

In the illustrated embodiment, layer 18 has a flat or planar upwardly facing or upper side 20, which forms the person facing side or person support surface. Optionally, upper side 20 may include angled planar portions, to form a taper, which may be desirable at the foot end, for example. It should be understood that upper side 18 may not be flat and instead to one degree or another generally follow the profile of the upper side of lower layer 12. Therefore, the thickness of layer 18 may be non-uniform or uniform.

The lower or downwardly facing side 22 of layer 18 is optionally contoured so that it substantially matches the contour of upwardly facing upper side 14 of layer 12 so that when both layers 12, 18 are assembled together and unloaded, with layer 18 on top of layer 12, person support 10 has upper and lower sides that are generally planar and parallel to one another. Though as noted above, the upper side of person support 10 may have a tapered portion, for example, at the foot end.

In the illustrated embodiment, upper side 14 of layer 12 has a contoured surface, while lower side 16 of layer 12 has a generally flat or planar surface. Further, upper side 14 has a surface topography with at least a first region 24 with a curvature configured to correspond and generally conform, in an unloaded state, to the shape of a first portion of the person's body, such as the person's buttock and hips. The remaining portion or portions of upper side 14 may then be generally planar. Further, the surface topography of upper side 14 may include a second region 26 with a curvature configured to correspond and generally conform, in an unloaded state, to the shape of a second portion of the person's body, such as the person's upper back. Alternately, as noted, the upper side 14 may have only one contoured region with the remaining portion (or portions) of the upper side being generally flat or planar.

As best seen in FIG. 2, the surface topography of the upper side 14 of layer 12 optionally includes a third region 28 that has a curvature configured to correspond and generally conform to the shape of a third portion of the person's body, such as the calves of a person.

In addition, the surface topography of upper side 14 of layer 12 may include another, fourth region 30 that corresponds to and generally conforms to a fourth portion of a person's body, such as the heels of a person.

Additionally, the surface topography may include another region 32 at the head end 12*a* that is contoured for the head.

In this manner, the profile of upper side 14 of layer 12 may follow a person's full body profile, from head to toe.

Figure 9:
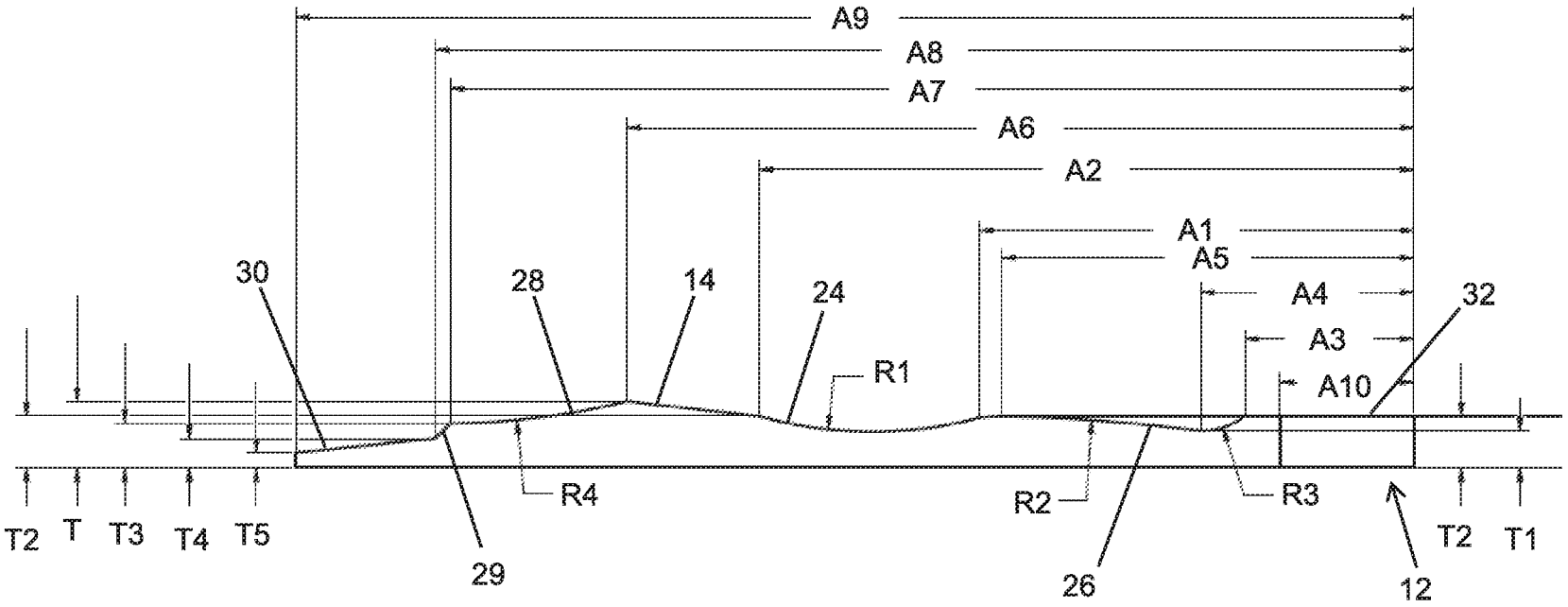
FIG. 9 is a side elevation view of the lower layer of FIG. 8.

Referring again to FIG. 9, the shape of each region may vary, including curved regions and regions that are substantially planar but angled so they are not parallel with the lower surface of layer 12. For example, region 24 may have a concave curvature with a radius R1 of curvature in a range of about 26 to 30 inches (66.0 to 76.2 cm), optionally in a range of about 27 to 29 inches (68.6 to 73.7 cm), and, for example, about 28.6 inches (72.6 cm). As noted above, these radii of curvature can be based on an average person's body profile or a generalized profile of a group of people. It should be understood, therefore, that these dimensions, and any other dimensions or angles, described herein are exemplary and are not limiting.

The curvature of region 26 may include multiple convex curvatures with the curvature that corresponds to the lower end of the back of a person having a radius R2 in a range of about 125 to 130 inches (317.5 to 330.2 cm), optionally in a range of about 126 to 129 inches (320.0 to 327.7 cm), and, for example, about 127.6 inches (324.1 cm). The second convex curvature which corresponds to the uppermost portion of the person's back (at the shoulders) has a radius R3 in a range of about 3 to 7 inches (7.6 to 17.8 cm), in a range of about 4 to 6 inches (10.2 to 15.2 cm), or about, for example, 5.0 inches (12.7 cm).

Region 28 may include a convex curvature with a radius R4 in a range of about 50 to 56 inches (127.0 to 142.2 cm), optionally in a range of about 51 to 55 inches (129.5 to 139.7 cm), and, for example, about 53.4 inches (135.6 cm).

Region 30 may be flat or may include a convex curvature with very large radius, such that it is almost flat and also optionally angled in a range of about 2 to 12 degrees relative to horizontal, in a range of about 4 to 10 degrees relative to horizontal, or, for example, about 6 degrees. As noted above, region 30 may generally follow the contour of a person's heels—to that end, for example, region 30 may have a curvature or curvatures (convex curvature(s)) about the longitudinal axis and/or lateral axis of layer 12 to generally follow the contour of a person's heels (see phantom lines in FIG. 2). The curvature may be centrally located or may extend across the full width and/or length of the region 30.

Again, as noted above, these curved regions or angled regions are positioned to align with respective body portions. For example, region 24 may start at a distance A1 in range of about 28 to 31 inches (71.1 to 78.7 cm) from the head end 12*a* (FIG. 8) of layer 12, in a range of about 29 to 30 inches (73.7 to 76.2 cm) from the head end 12*a*, or, for example, about 29.5 inches (74.9 cm) from the head end 12*a*. Region 24 may terminate at a distance A2 from the head end 12*a* in a range of about 43 to 46 inches (109.2 to 116.8 cm), in a range of about 44 to 45 inches (111.8 to 114.3 cm), or, for example, about 44.5 inches (113.0 cm).

Region 26 may start at a distance A3 in range of about 9 to 13 inches (22.9 to 33.0 cm) from the head end 12*a* (FIG. 8) of layer 12, in a range of about 10 to 12 inches (25.4 to 30.5 cm) from the head end 12*a*, or, for example, about 11.5 inches (29.2 cm) from the head end 12*a*. Further, the transition between the smaller curvature and the larger curvature may start at a distance A4 in a range of about 12 to 16 inches (30.5 to 40.6 cm), in a range of about 13 to 15 inches (33.0 to 38.0 cm), or, for example, about 14.5 inches (36.8 cm) from the head end 12*a*.

Region 26 may terminate at a distance A5 from the head end 12*a* in a range of about 26 to 30 inches (66.0 to 76.2 cm), in a range of about 27 to 29 inches (68.6 to 73.7 cm), or, for example, about 28 inches (71.1 cm).

Region 28 may start at a distance A6 in range of about 51 to 55 inches (129.5 to 139.7 cm) from the head end 12*a* (FIG. 8) of layer 12, in a range of about 52 to 54 inches (132.1 to 137.2 cm) from the head end 12*a*, or, for example, about 53.5 inches (135.9 cm) from the head end 12*a*. Region 28 may terminate at a distance A7 from the head end 12*a* in a range of about 62 to 68 inches (157.5 to 172.7 cm), in a range of about 63 to 67 inches (160.0 to 170.2 cm), or, for example, about 65.5 inches (166.4 cm).

Referring again to FIG. 8, region 30 may start at a distance A8 in range of about 60 to 72 inches (152.4 to 182.9 cm) from the head end 12*a* (FIG. 8) of layer 12, in a range of about 62 to 70 inches (157.5 to 177.8 cm) from the head end 12*a*, or, for example, about 66.5 inches (168.9 cm) from the head end 12*a*. Region 30 terminates at a distance A9, which is the distance to the foot end 12*b* of layer 12. Optionally, there may be a transition, such as an offset 29 between region 28 and region 30 so that the height of region 30 is appropriate for a person's feet.

Region 32, which starts at head end 12*a* may extend from the head end 12*a* a distance A10 in range of about 8 to 10 inches (20.3 to 25.4 cm) from the head end 12*a* (FIG. 8) of layer 12, in a range of about 8.5 to 9.5 inches (21.6 to 24.1 cm) from the head end 12*a*, or, for example, about 9.1 inches (23.1 cm) from the head end 12*a*.

As noted above, the lower side of layer 18 follows the contours of upper side 14 of layer 12 and, therefore, has mirror image regions at the same location as noted above. Optionally, upper side 20 of layer 18 may include a tapered region 34 at the foot end so that the majority of upper side 20 is flat or planar, but with a tapered foot end. For example, tapered region 34 of upper side 20 may have a convex curvature with a radius R5 in a range of about 38 to 42 inches (96.5 to 106.7 cm), in a range of about 39 to 41 inches (99.1 to 104.1 cm), or, for example, of about 40 inches (101.6 cm). Region 34 may start at the same distance as distance A8, which is in a range of 60 to 72 inches (152.4 to 182.9 cm), in a range of 62 to 70 inches (157.5 to 177.8 cm), or, for example, about 66.5 inches (168.9 cm) and terminate at the foot end 12*b* (FIG. 5) of layer 18. The typical length A9 of layer 12 for a mattress is about 76 inches (193.0 cm), while the width W may be about 30 inches (76.2 cm). Optionally the head end of layer 12 includes tapered corners 12*c*, 12*d* at its head end 12*a*, with layer 18 having similar tapered angled portions 18*a*, 18*b*.

The thickness of layer 12 may, therefore, vary along its length. For example, the thickest part of layer 12 may have a thickness T of about 4.5 inches (11.4 cm). The thickness T1 at regions 24 and 26 may be in a range of 3.0 to 3.5 inches (7.6 to 8.9 cm) or about 2.5 inches (6.4 cm). The thickness T3 at region 28 may be in a range of 2.5 to 3.5 inches (6.4 to 8.9 cm) or about 3.0 inches (7.6 cm). The starting thickness T4 at region 30 may be in a range of 1.5 to 2.5 inches (3.8 to 6.4 cm) or about 2.0 inches (5.1 cm). The ending thickness T5 at region 30 may be in a range of 0.5 to 1.5 inches (1.3 to 3.8 cm) or about 1.0 inches (2.5 cm). The thickness T2 at region 32 may be in a range of 3.0 to 4.0 inches (7.6 to 10.2 cm) or about 3.5 inches (8.9 cm).

Optionally, support 10 may include a third layer 40 or other additional layers. For example, third layer 40 (FIG. 2) may be positioned between layer 12 and layer 18 or beneath layer 14 or above layer 12. For example, layer 40 may be formed from a resilient material, such as foam, 3D fabric, gel, or fluid bladders, or a combination of two or more thereof. The third layer or other additional layers may each have a uniform thickness or a non-uniform thickness similar to layer 18.

In any of the above embodiments, one or more of the layers may form a part of a low air loss system. For example, one or more of the layers may have transverse openings there through to direct the flow of air, for example, from tubing located beneath or in layer 12, through support 10. For further details of a suitable control system and pneumatic system, reference is made to U.S. Pat. No. 9,089,462 and U.S. Pat. Pub. Appl. 2014/0068869, which are commonly owned by Stryker Corporation and are incorporated by reference herein in their entireties.

In one embodiment, the transverse openings are formed by the material forming the layer. As noted above, any of the layers (14, 18, 40) may be formed from 3D fabric, which has not only transverse passageways between the fibers forming the material but also lateral and longitudinal passageways. The flow of air through the layer may be controlled by sealing the surfaces when air flow is not desired. For example, the layer may be coated with a material, such as polyurethane film, vinyl, or GORE-TEX™.

Alternately, the transverse openings may be formed in the layer by drilling, punching, or when forming the layer. In one embodiment, one or more of the layers are formed from gel. The gel layer may be formed from a number of suitable gels, such as described below, and a number of different gel configurations, including the buckling column configurations, which are formed by intersecting walls, such as described in the referenced patents. For example, the gel layer may be formed by a plurality of intersecting gel walls that form a matrix with hollow spaces formed between the gel walls, which can form the transverse openings for the air flow to flow through the gel layer. One group of walls may be orthogonal to the other group of walls so that the spaces are rectangular or square or they may be angled and further include additional groups of walls so that the each of the spaces may be formed by walls that form acute angles and/or may have different shapes other than rectangular or square and further may vary in size. Air flow may, therefore, be directed through the hollow spaces in the gel layer.

Additionally, while these spaces may extend all the way through the gel layer, the spaces may be closed on one end or somewhere between their ends by a gel skin layer, with optional openings formed in the gel skin layer to again allow air flow through the gel layer.

Suitable dry polymer gels or gelatinous elastomeric materials for forming the gel layer may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadyene) to form a SEBS polymer, or hydrogenated poly(isoprene+butadiene) to form a SEEPS polymer. For examples of suitable dry polymer gels or gelatinous elastomeric materials, the method of making the same and various suitable configurations for the gel layer reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413, 458; 7,730,566; 7,823,233; 7,827,636; 7,823,234; and 7,964,664, which are all incorporated herein by reference in their entireties. Other suitable configurations are described in copending application, entitled PATIENT SUPPORT, Ser. No. 61/697,010, filed Sep. 5, 2012, commonly owned by Stryker Corp. of Kalamazoo, Mich., which incorporated herein by reference in its entirety.

Other formulations of gels or gelatinous elastomeric materials may also be used in addition to those identified in these patents. As one example, the gelatinous elastomeric material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil and one or more stabilizers may also be used. Additional ingredients—such as, but not limited to—dye may also be added. In addition to these two examples, as well as those disclosed in the aforementioned patents, still other formulations may be used.

As noted above, layer 18 may comprise a resilient layer. Layer 18 may be formed from a soft compressible layer (which is substantially softer than layer 12) so that it can compensate for variations in the shapes of the person of different body shapes and sizes. As would be understood, therefore while the upper side of layer is generally planar when unloaded, when loaded layer 18 compresses so that support 10 generally follows the curves of a person's body when the person is lying on support 10. Because layer 18 may be substantially softer than layer 12, layer 18 does not generate significant forces on the person's skin as it compresses and instead just accommodates the variations between body sizes and shapes. For example, layer 18 may be formed from polyurethane foam, such as memory foam, with a IFD (Indentation Load Deflection) in a range of about 10 to 30, in a range of about 15 to 25, or, for example, about 20. Layer 12, on the other hand, may also be formed from polyurethane foam, but with a higher IFD value, such as an IFD in a range of about 25 to 50, in a range of about 30 to 40, or, for example, about 35. Alternately, as noted above, layer 12 may be formed from a rigid material instead.

As noted above, the plurality of regions of the surface topography of the upper side 14 of layer 12 form a profile with a shape to generally follow the shape of a person's body (e.g. average person or generalized person), including a portion or portions of the person's body or the full length of the person's body.

In addition, the surface topography of the upper side of layer 12 may have a plurality of regions that form a profile with a shape (in an unloaded state) to generally follow the shape of a person's body laterally and longitudinally. In this manner, the surface topography mimics the person's body profile in three dimensions (3-D). Similarly, in this embodiment the surface topography of the lower side of layer 18 follows the 3-D profile of the upper side of layer 12.

As noted above, the region or regions of the surface topography can generally follow the shape of at least a portion of a person's body in a supine position or seated position. Further, when the surface topography generally follows the shape of the person's body when in a supine position, if the person stays in their general position along the longitudinal axis of support 10 when sitting up, the contour that corresponds to the person's buttocks and hips will still closely follow the shape of the person's buttocks and hips.

As noted above, different versions of support 10 may be formed for a smaller range of people or for different applications.

Although generally described in the context of one or more unitary layers, layer 12 may be formed from discrete components, for example, discrete panels of material, such as foam, gel, 3-D fabric, plastic, wood, metal, or other compressible or rigid materials or a combination of thereof, which are then each supported on a spring. In this manner, each discrete panel can respond independently of the other panels and, further, be adjusted to potentially cover a greater range of body sizes and shapes. One or more of the panels may be curved similar to the curved portions of layer 12 described above.

Accordingly, when layer 12 is formed from a resilient material and its surface topography at its upper side (in an uncompressed state) has a profile to generally follow the shape of at least a portion of a person's body in a supine position or seated position, layer 12 may be configured to deform substantially equally at each point of contact so that the resulting distribution of pressure on the person's body will be substantially equal. Alternately, the profile may be tailored to distribute the reaction forces in a non-uniform manner. For example, where reduction of the reaction force is desired in a particular area, such as, in areas of higher likelihood of pressure injury—namely the sacral region or heels, the profile could have an alternate shape that would lessen the deformation of the resilient material reducing local reaction forces in that desired area or areas.

As noted above, support 10 may include one or more resilient inserts or resilient layers to actively or passively modify the surface topography of the upper side of layer 12.

As noted, person support 10 may comprise a cushion or mattress for a bed, a stretcher, a recliner chair, an OR table, or an emergency medical cot or the like. For a stretcher application, for example, the profile of layer 12 may follow a person's profile when sitting at a 45 degree angle. For a Med Surg bed, the profile of layer 12 may follow a person's profile when sitting at a 30 degree angle, for example. For an ICU bed, in one example, the profile of layer 12 may follow a person in a supine position angled in a range of about 0 degrees to 10 degrees, or about 1 degree to 5 degrees or at about 2 degrees. Further, as noted above, support 10 may be configured to support an object.

This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This comprises, for example, presently known alternative elements, such as those that might be currently known to one skilled in the art, and alternative elements that may be developed in the future, such as those that one skilled in the art might, upon development, recognize as an alternative. Further, the disclosed embodiments comprise a plurality of features that are described in concert and that might cooperatively provide a collection of benefits. Also, as noted above, the system of the present invention may be used on other pneumatic systems. Therefore, the present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

We claim:

1. A person support for supporting a person, the person support comprising:

a first layer having a foot end, a head end, a longitudinal axis, an upper surface extending along said longitudinal axis between said foot end and said head end, and a lower surface, said upper surface having a surface topography with: (1) a first region having a first curvature with a radius R1 configured to correspond and generally conform in an unloaded state to a buttocks and hip region of the person's body, (2) a second region having a second curvature with a radius R2 configured to correspond and generally conform in an unloaded state to a lower portion of a back of the person's body and a third curvature with a radius of R3 configured to correspond and generally conform in an unloaded state to shoulders of the person's body, and (3) a third region having a fourth curvature with a radius R4 configured to correspond to and generally conform in an unloaded state to calves of the person's body when in a supine position, and the upper surface being substantially continuous along said longitudinal axis wherein R2 is greater than R4, R4 is greater than R1, and R1 is greater than R3 wherein said surface topography in an unloaded state forms a longitudinal profile based on a generalized profile of a group of people so that said surface topography closely follows a curvature of the person when supported thereon; and a resilient second layer overlaying the first layer, when unloaded the resilient second layer includes a generally planar upper surface facing the person when supported on the person support and a lower surface facing the first layer and following the surface topography of the first layer, said first layer having a first IFD in a range of 25 to 50, and said resilient second layer comprising a second IFD in a range of 10 to 30, but with said first IFD being greater than said second IFD wherein a said resilient second layer is softer than said first layer so that said resilient second layer compensates for variations of the curvature of the person from the surface topography of the first layer, and said generally planar upper surface is substantially continuous wherein when a person lies or sits on said resilient second layer the resulting distribution of pressure on the person's body will be substantially equal.

2. The person support according to claim 1, wherein said first layer has a fourth region having a generally flat surface but not parallel to the lower surface that corresponds to heels of the person's body.

3. The person support according to claim 1, wherein the resilient second layer comprises a foam layer, a gel layer, a 3D fabric layer, a bladder layer or a combination of two or more thereof.

4. The person support according to claim 1, wherein said first layer comprises a foam layer, a gel layer, a 3D fabric layer, a bladder layer, or a combination of two or more thereof.

5. The person support according to claim 1, further comprising a third layer, the third layer positioned either between the first layer and the resilient second layer or beneath the first layer or on top of the second layer.

6. The person support according to claim 1, wherein the layers form a mattress.

7. A person support for supporting persons of different body shapes and sizes, the person support comprising:

a first layer having an upper side, a lower side, a head end, a foot end, and a longitudinal axis extending between said head end and said foot end;

a resilient second layer having a lower side, an upper side, and a non-uniform thickness, the lower side of the resilient second layer facing the upper side of the first layer, and the upper side of the resilient second layer forming a person facing side and being substantially continuous, and said resilient layer comprising a substantially softer layer than said first layer so that said resilient second layer compensates for variations of the shape of the person from the surface topography of the first layer; and the upper side of the first layer having an upper surface and a surface topography, the surface topography of the upper side of the first layer having at least three curvatures, each curvature having a shape in an unloaded state to generally follow the shape of at least one portion of a person's body along at least along the longitudinal axis of the first layer and having a different radius of curvature than the other curvatures and wherein said surface topography forms a longitudinal profile based on a generalized profile of a group of people so that said surface topography closely follows a curvature of the person supported thereon, and the lower side of the resilient second layer has a surface topography, the upper surface being substantially continuous between said head end and said foot end, the surface topography of the lower side of the resilient second layer substantially matching the surface topography of the upper side of the first layer, said first layer having a first IFD in a range of 25 to 50, and said resilient second layer comprising a second IFD in a range of 10 to 30, but with said first IFD being greater than said second IFD wherein said resilient second layer is softer than said first layer to accommodate variations in the shapes of the persons of different body shapes and sizes wherein when a person lies or sits on the resilient second layer the resulting distribution of pressure on the person's body will be substantially equal.

8. The person support according to claim 7, wherein the upper side of the resilient second layer is generally planar when unloaded.

9. The person support according to claim 7, wherein at least one of the layers forms a component of a low air loss system.

10. The person support according to claim 7, further comprising a third layer between the first layer and the resilient second layer, or beneath said first layer, or on top of said resilient second layer.

11. The person support according to claim 10, wherein at least one of the layers forms a component of a low air loss system.

12. The person support according to claim 7, wherein the at least three curvatures comprise at least four curvatures to generally follow the shape of the full length of a person's body.

13. The person support according to claim 7, wherein the at least three curvatures comprise at least four curvatures to generally follow the shape of a person's body laterally and longitudinally.

14. A method of forming a person support for supporting a person, the method comprising:

providing a first layer having an upper surface, a head end, a foot end, a longitudinal axis extending between said head end and said foot end, and a surface topography, said surface topography with a plurality of regions, each region with at least one curvature configured to correspond and generally conform in an unloaded state to a shape of a portion of the person's body supported thereon, each curvature being different than the other curvatures wherein said surface topography forms a longitudinal profile based on a generalized profile of a group of people so that said surface topography closely follows a curvature of the person supported thereon, and the upper surface being substantially continuous;

overlaying a resilient second layer with a substantially continuous upper surface over the first layer wherein said first layer has a first IFD in a range of 25 to 50, said resilient second layer having a second IFD in a range of 10 to 30, but with the first IFD being greater than said second IFD wherein said resilient second layer is softer than said first layer so that said resilient second layer compensates for variations of the shape of the person from the surface topography of the first layer; and forming a person support surface with the resilient second layer wherein when a person lies or sits on the resilient second layer the resulting distribution of pressure on the person's body will be substantially equal.

* * * * *